US006564532B2

(12) United States Patent
Gutche

(10) Patent No.: US 6,564,532 B2
(45) Date of Patent: May 20, 2003

(54) STRETCH WRAP DEVICE

(76) Inventor: Robert J. Gutche, 521 S. Jackson St. Apt. 4, Greenbay, WI (US) 54301

( * ) Notice: Subject to any disclaimer, the term of this patent is extended or adjusted under 35 U.S.C. 154(b) by 81 days.

(21) Appl. No.: 09/726,772

(22) Filed: Nov. 29, 2000

(65) Prior Publication Data

US 2002/0062630 A1 May 30, 2002

(51) Int. Cl.[7] ..... B65B 13/04

(52) U.S. Cl. ..... 53/556; 53/390; 53/580; 53/592

(58) Field of Search ..... 53/556, 588, 390, 53/592

(56) References Cited

U.S. PATENT DOCUMENTS 4,067,174 A 1/1978 Goldstein
4,079,565 A * 3/1978 Lancaster, III et al. ..... 53/588
4,136,501 A 1/1979 Connolly
4,166,348 A * 9/1979 Carlson ..... 53/556
D262,887 S 2/1982 Powell
4,369,614 A 1/1983 Tetzner
D272,540 S 2/1984 Goldstein
4,658,570 A * 4/1987 Thomas ..... 53/588
4,722,170 A 2/1988 Ball et al.
4,905,448 A * 3/1990 Plitt ..... 53/588
4,938,008 A 7/1990 Salzsauler
5,673,542 A * 10/1997 Vartanian et al. ..... 53/556
6,151,863 A * 11/2000 Lancaster, III et al. ..... 53/588

* cited by examiner

*Primary Examiner*—John Sipos

(57) ABSTRACT

A stretch wrap device for wrapping a raised pallet with stretch wrap. The stretch wrap device includes a carriage assembly, a frame assembly and a lever assembly. The frame assembly is securely attached to a top surface of the carriage assembly and extends upwardly therefrom. The lever assembly moves a roll of the stretch wrap around a raised pallet. The lever assembly is rotatably coupled to the frame assembly. The stretch wrap is positioned on the lever assembly such that the stretch wrap may be wound about the pallet along an axis orientated generally parallel to a plane of a bottom surface of the pallet.

2 Claims, 3 Drawing Sheets

STRETCH WRAP DEVICE

BACKGROUND OF THE INVENTION

1. Field of the Invention

The present invention relates to stretch wrap devices and more particularly pertains to a new stretch wrap device for wrapping a raised pallet with stretch wrap.

2. Description of the Prior Art

The use of stretch wrap devices is known in the prior art. More specifically, stretch wrap devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,067,174; 4,136,501; 4,938,008; 4,722,170; 4,369,614; Des. 262,887; and Des. 272,540.

While these devices fulfill their respective, particular objectives and requirements, the aforementioned patents do not disclose a new stretch wrap device. The inventive device includes a carriage assembly, a frame assembly and a lever assembly. The frame assembly is securely attached to a top surface of the carriage assembly and extends upwardly therefrom. The lever assembly moves a roll of the stretch wrap around a raised pallet. The lever assembly is rotatably coupled to the frame assembly. The stretch wrap is positioned on the lever assembly such that the stretch wrap may be wound about the pallet along an axis orientated generally parallel to a plane of a bottom surface of the pallet.

In these respects, the stretch wrap device according to the present invention substantially departs from the conventional concepts and designs of the prior art, and in so doing provides an apparatus primarily developed for the purpose of wrapping a raised pallet with stretch wrap.

SUMMARY OF THE INVENTION

In view of the foregoing disadvantages inherent in the known types of stretch wrap devices now present in the prior art, the present invention provides a new stretch wrap device construction wherein the same can be utilized for wrapping a raised pallet with stretch wrap.

The general purpose of the present invention, which will be described subsequently in greater detail, is to provide a new stretch wrap device apparatus and method which has many of the advantages of the stretch wrap devices mentioned heretofore and many novel features that result in a new stretch wrap device which is not anticipated, rendered obvious, suggested, or even implied by any of the prior art stretch wrap devices, either alone or in any combination thereof.

To attain this, the present invention generally comprises a carriage assembly, a frame assembly and a lever assembly. The frame assembly is securely attached to a top surface of the carriage assembly and extends upwardly therefrom. The lever assembly moves a roll of the stretch wrap around a raised pallet. The lever assembly is rotatably coupled to the frame assembly. The stretch wrap is positioned on the lever assembly such that the stretch wrap may be wound about the pallet along an axis orientated generally parallel to a plane of a bottom surface of the pallet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stretch wrap device apparatus and method which has many of the advantages of the stretch wrap devices mentioned heretofore and many novel features that result in a new stretch wrap device which is not anticipated, rendered obvious, suggested, or even implied by any of the prior art stretch wrap devices, either alone or in any combination thereof.

It is another object of the present invention to provide a new stretch wrap device which may be easily and efficiently manufactured and marketed.

It is a further object of the present invention to provide a new stretch wrap device which is of a durable and reliable construction.

An even further object of the present invention is to provide a new stretch wrap device which is susceptible of a low cost of manufacture with regard to both materials and labor, and which accordingly is then susceptible of low prices of sale to the consuming public, thereby making such stretch wrap device economically available to the buying public.

Still yet another object of the present invention is to provide a new stretch wrap device which provides in the apparatuses and methods of the prior art some of the advantages thereof, while simultaneously overcoming some of the disadvantages normally associated therewith.

Still another object of the present invention is to provide a new stretch wrap device for wrapping a raised pallet with stretch wrap.

Yet another object of the present invention is to provide a new stretch wrap device which includes a carriage assembly, a frame assembly and a lever assembly. The frame assembly is securely attached to a top surface of the carriage assembly and extends upwardly therefrom. The lever assembly moves a roll of the stretch wrap around a raised pallet. The lever assembly is rotatably coupled to the frame assembly. The stretch wrap is positioned on the lever assembly such that the stretch wrap may be wound about the pallet along an axis orientated generally parallel to a plane of a bottom surface of the pallet.

Still yet another object of the present invention is to provide a new stretch wrap device that is movable about a pallet with a carriage having wheels thereon.

Even still another object of the present invention is to provide a new stretch wrap device that wraps a pallet along the bottom and over the top of the pallet for greater stability of the material on the pallet as opposed to conventional stretch wrapping devices which wrap around the material on a pallet along an axis orientated perpendicular to the pallet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
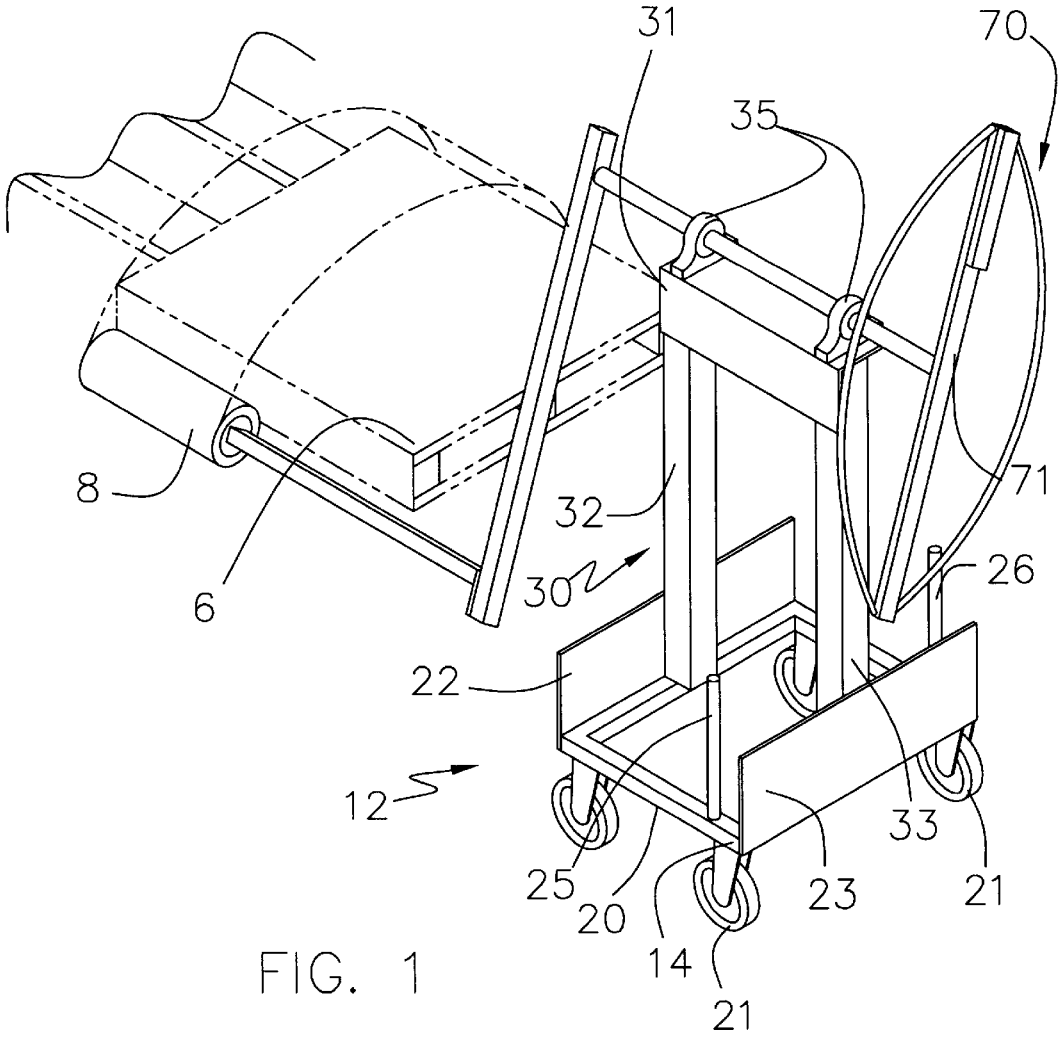
FIG. 1 is a schematic perspective view of a new stretch wrap device according to the present invention.
Figure 2:
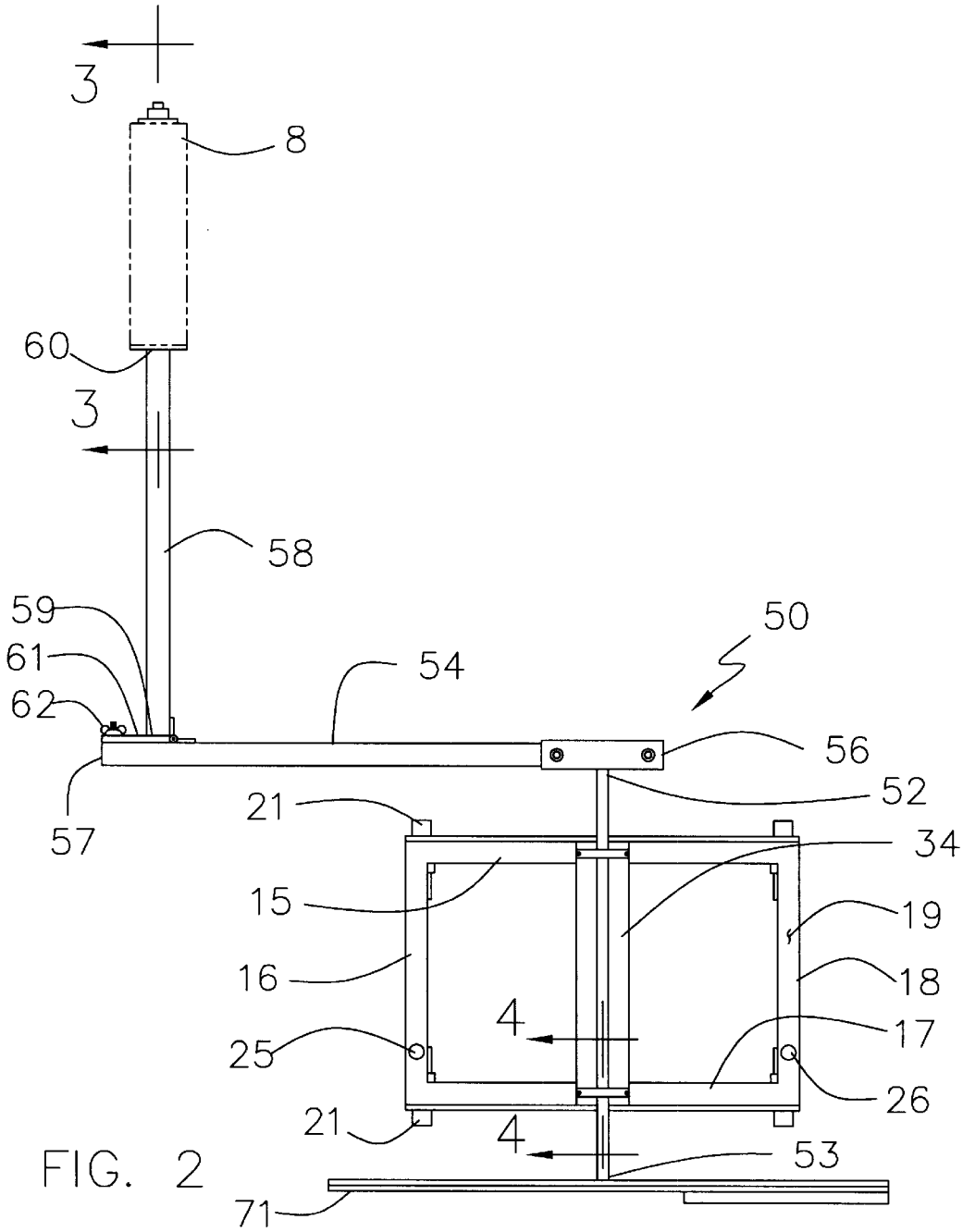
FIG. 2 is a schematic plan view of the present invention.
Figure 3:
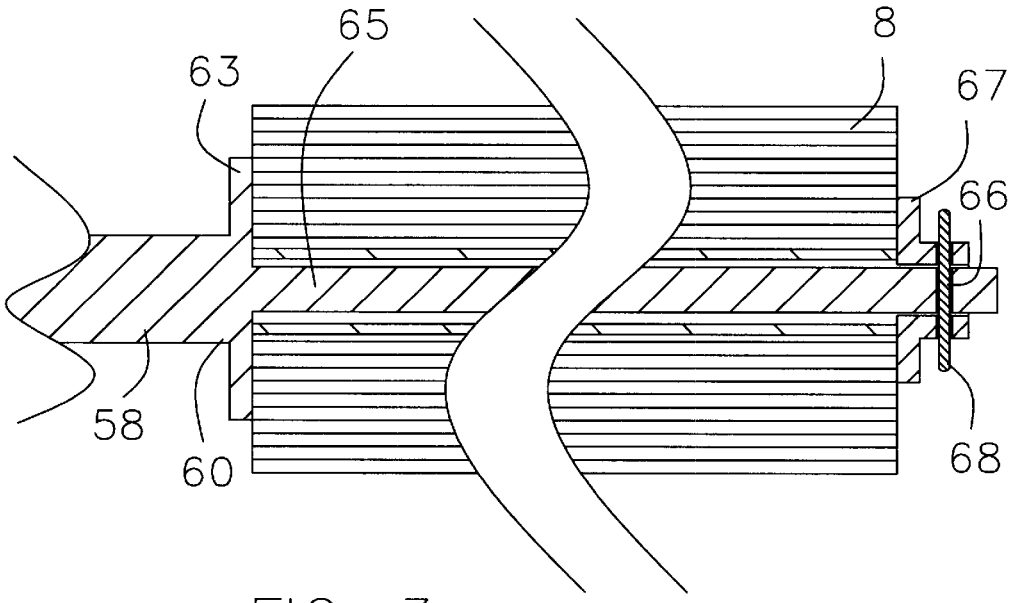
FIG. 3 is a schematic cross-sectional view taken along line 3—3 of the present invention.
Figure 4:
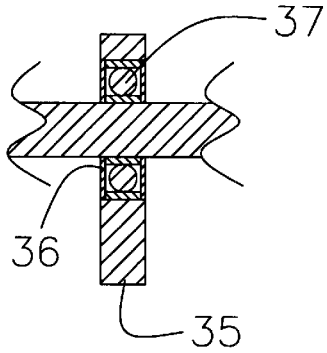
FIG. 4 is a schematic cross-sectional view taken along line 4—4 of the present invention.

With reference now to the drawings, and in particular to FIGS. 1 through 4 thereof, a new stretch wrap device embodying the principles and concepts of the present invention and generally designated by the reference numeral 10 will be described.

As best illustrated in FIGS. 1 through 4, the stretch wrap device 10 generally comprises a carriage assembly 12, a frame assembly 30 and lever assembly 50 for moving a roll of conventional plastic stretch wrap 8 about a pallet 6 to wrap the pallet 6, and whatever material may be on the pallet 6 with stretch wrap 8.

The carriage assembly 12 includes a frame 14 having a generally rectangular shape. The frame has a first bar 15, a second bar 16, a third bar 17 and a fourth bar 18. The frame 14 has a top surface 19 and a bottom surface 20. A plurality of wheels 21 is rotatably coupled to the bottom surface 20 of the frame 14. A first wall 22 extends upwardly from and is securely attached to the first bar 15 and a second wall 23 extends upwardly from and is securely attached to the third bar 17. The first 15 and third 17 bars are positioned opposite of each other.

A first rod 24 is securely attached to the second bar 16 and extends upwardly therefrom and a second rod 25 is securely attached to the fourth bar 18 and extends upwardly therefrom. Rolls of stretch wrap 8 may be positioned on one of the first 24 or second 25 rods for storage purposes.

The frame assembly 30 is securely attached to the top surface 19 of the carriage assembly 12. The frame assembly 30 includes a stanchion 31 with a first vertical implement 32 securely attached to the frame 14 and extending upwardly therefrom and a second vertical implement 33 securely attached to the frame 14 and extending upwardly therefrom. The first 32 and second 33 vertical implements are positioned on opposite bars with respect to each other on the frame such that the first vertical implement 32 extends from the first bar 15 and the second vertical implement 33 extends from the third bar 17. Each of the vertical implements 32, 33 has a height equal to each other and greater than four feet. A beam 34 is securely attached to each of a free end of the first 32 and second 33 vertical implements such that the beam 34 traverses a gap between the first and second vertical implements.

Each of a pair of brackets 35 is securely attached to an upper surface of the beam 34. The brackets 35 are spaced from each other such that each of the brackets 35 is located nearer one of the vertical implements 32, 33. Each of the brackets 35 has an opening 36 extending therethrough. The openings 36 are generally coaxial with each other. Each of the openings 36 has an inner surface comprising ball bearings 37. Each of the brackets 35 comprises a pillow block.

The lever assembly 50 for moving the roll of the stretch wrap 8 around the pallet 6 includes a spindle 51 extending through each of the openings 36 in the brackets 35 such that the spindle 51 is rotatable along a longitudinal axis of the spindle 51. The spindle 51 has a first end 52 and a second end 53 each extending beyond opposite sides of the carriage 12.

An elongated member 54 has a first end 56 and a second end 57. The first end 52 of the spindle 51 is securely attached to the elongated member 54 and positioned generally adjacent to the first end 56 of the elongated member 54. The elongated member 54 is in a generally perpendicular orientation to the spindle 51. The elongated member 54 has a length generally equal to a distance from the brackets 35 to the frame 14.

An arm 58 is elongated and has a first end 59 and a second end 60. The first end 59 of the arm 58 is hingedly coupled to the elongated member 54 and positioned generally adjacent to the second end 57 of the elongated member 54. The arm 58 is selectively movable between an abutting position and a perpendicular orientation with respect to the elongated member 54. The arm 58 extends in a direction generally opposite of the spindle 51 when perpendicular to the elongated member 54. A plate 61 is securely attached to the first end 59 of the arm 58. A fastening means 62 comprising a bolt coupled to the elongated member 54 and extendably through the plate 61 for coupling to a nut removably fastens the plate 61 to the elongated member 54 such that the arm 58 is secured in the perpendicular orientation with respect to the elongated member 54. The second end 60 of the arm 58 has an annular lip 63 integrally coupled thereto. The arm 58 has a length greater than three feet.

A shaft 65 is integrally coupled to and extends away from the second end 60 of the arm 58 such that a longitudinal axis of the arm 58 is orientated generally parallel to a longitudinal axis of the shaft 65. The roll of stretch wrap 8 is positionable on the shaft 65 and the roll of stretch wrap is positioned against the annular lip 63. The shaft 65 has a hole 66 therethrough positioned generally adjacent to a free end of the shaft 65 and orientated generally perpendicular to the longitudinal axis of the shaft 65.

A securing member is positionable over the free end of the shaft to removably secure the roll of stretch wrap 8 on the shaft 65. The securing member includes a collar 67 that is positionable over the free end of the shaft 65. A pin 68 is extendable through the collar 67 and the hole 66 in the shaft 65 for removably securing the collar 67 to the shaft 65.

A handle 70 for rotating the spindle includes an elongated pole 71. The second end 53 of the spindle 51 is securely attached to a central portion of the pole 71 such that the pole 71 is orientated generally perpendicular to the spindle 51.

In use, a pallet 6 is raised into the air so that the device 10 may wrap stretch wrap under and over the pallet 6. The stretch wrap 8 is positioned on the shaft 65 such that the stretch wrap may be wound about the pallet along an axis orientated generally parallel to a plane of a bottom surface of the pallet. Rotating the handle 70 rotates the spindle 51 which in turn causes the arm 58 to move around the pallet. The arm 58 is abuttable against the elongated member 54 for storage purposes. The carriage 12 has wheels 21 so that the device 10 may be moved about the pallet 6 to secure the corners of pallet and such.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. The stretch wrap device for stretch wrapping a raised pallet and material positioned theron, the stretch wrapping being dispensable from a roll of stretch wrapping, said device comprising:

a carriage assembly having a plurality of wheels for facilitating movement of said device;

a frame assembly being securely attached to a top surface of said carriage assembly and extending upwardly therefrom;

a lever assembly for moving a roll of said stretch wrap around said pallet, said lever assembly being rotatably coupled to said frame assembly, said lever assembly including a spindle for facilitating movement of said roll of stretch wrap along a length of said pallet; and wherein said stretch wrap is positioned on said lever assembly such that said stretch wrap may be wound about said pallet along an axis orientated generally parallel to a plane of a bottom surface of said pallet;

wherein said lever assembly comprises:

said spindle being rotatably coupled to said frame assembly, said spindle having a first end and a second end each extending beyond opposite sides of said carriage;

an elongated member having a first end and a second end, said first end of said spindle being securely attached to said elongated member and positioned generally adjacent to said first end of said elongated member, said elongated member being in a generally perpendicular orientation to said spindle;

an arm being elongated and having a first end and a second end, said first end being hingedly coupled to said elongated member and positioned generally adjacent to said second end of said elongated member, said arm being selectively movable between an abutting position and a perpendicular orientation with respect to said elongated member, wherein said arm may extend in a direction generally opposite of said spindle; and a shaft being integrally coupled to and extending away from said second end of said arm such that a longitudinal axis of said arm is orientated generally parallel to a longitudinal axis of said shaft, said roll of stretch wrap being positionable on said shaft;

wherein said lever assembly further includes:

a handle for rotating said spindle including an elongated pole, said second end of said spindle being securely attached to a central portion of said pole such that said spindle is orientated generally perpendicular to said pole.

2. A stretch wrap device for stretch wrapping a raised pallet and material positioned thereon, the stretch wrapping being dispensable from a roll of stretch wrapping, said device comprising:

a carriage assembly including;

a frame having a generally rectangular shape with a first bar, a second bar, a third bar and a fourth bar, said frame having a top surface and a bottom surface;

a plurality of wheels, each of said wheels being rotatably coupled to said bottom surface of said frame;

a first wall extending upwardly from and being securely attached to said first bar, a second wall extending upwardly from and being securely attached to said third bar, wherein said first and third bars are positioned opposite of each other;

a first rod being securely attached to said second bar and extending upwardly therefrom and a second rod being securely attached to said fourth bar and extending upwardly therefrom, wherein a roll of stretch wrap may be positioned on one of said first or second rods;

a frame assembly being securely attached to said top surface of said carriage assembly, said frame assembly including;

a stanchion with a first vertical implement being securely attached to said frame and extending upwardly therefrom and a second vertical implement being securely attached to said frame and extending upwardly therefrom, said first and second vertical implements being positioned on opposite bars, said first and second vertical implements being positioned opposite with respect to each other on said frame such that said first vertical implement extends from said first bar and said second vertical implement extends from said third bar, each of said vertical implements having a height equal to each other and greater than four feet;

a beam being securely attached to each of a free end of said first and second vertical implements such that said beam traverses a gap between said first and second vertical implements;

a pair of brackets each being securely attached to an upper surface of said beam, said brackets being spaced from each other such that each of said brackets is located nearer one of said vertical implements, each of said brackets having an opening extending therethrough, said openings being generally coaxial with each other, each of said openings having an inner surface comprising ball bearings, each of said brackets comprising a pillow block;

a lever assembly for moving a roll of said stretch wrap around said pallet, said lever assembly comprising;

a spindle extending through each of said openings in said brackets such that said spindle is rotatable along a longitudinal axis of said spindle, said spindle having a first end and a second end each extending beyond opposite sides of said carriage;

an elongated member having a first end and a second end, said first end of said spindle being securely attached to said elongated member and positioned generally adjacent to said first end of said elongated member, said elongated member being in a generally perpendicular orientation to said spindle, said elongated member having a length generally equal to a distance from said brackets to said frame;

an arm being elongated and having a first end and a second end, said first end being hingedly coupled to said elongated member and positioned generally adjacent to said second end of said elongated member, said arm being selectively movable between an abutting position and a perpendicular orientation with respect to said elongated member, wherein said arm may extend in a direction generally opposite of said spindle, a plate being securely attached to said first end of said arm, a fastening means removably fastens said plate to said elongated member such that said arm is secured in said perpendicular orientation with respect to said elongated member, said second end of said arm having an annular lip integrally coupled thereto;

a shaft being integrally coupled to and extending away from said second end of said arm such that a longitudinal axis of said arm is orientated generally parallel to a longitudinal axis of said shaft, said roll of stretch wrap being positionable on said shaft, said shaft having a hole therethrough positioned generally adjacent to a free end of said shaft, said hole being orientated generally perpendicular to said longitudinal axis of said shaft;

a securing member being positionable over said free end of said shaft to removably secure said roll of stretch wrap on said shaft, said securing member including;

a collar being positionable over said free end of said shaft;

a pin being extendable through said collar and said hole in said shaft for removably securing said collar to said shaft;

a handle for rotating said spindle including an elongated pole, said second end of said spindle being securely attached to a central portion of said pole such that said pole is orientated generally perpendicular to said spindle; and wherein said stretch wrap is positioned on said shaft such that said stretch wrap may be wound about said pallet along an axis orientated generally parallel to a plane of a bottom surface of said pallet.

* * * * *